United States Patent [19]

Nolet

[11] Patent Number: 4,900,011

[45] Date of Patent: Feb. 13, 1990

[54] EXERCISER AND PLAYPEN STRUCTURE HAVING A TRAMPOLINE LIKE BOTTOM

[76] Inventor: Leopold Nolet, 813 Brock Rd., Suites 3 & 4, Pickering, Ontario, Canada, L1W 3L8

[21] Appl. No.: 126,838

[22] Filed: Nov. 30, 1987

[30] Foreign Application Priority Data

Dec. 30, 1986 [CA] Canada ..... 526493

[51] Int. Cl.[4] ..... A63B 5/16

[52] U.S. Cl. ..... 272/65; 5/98 R; 5/99 A; 5/99 C

[58] Field of Search ..... 272/65, 66, 70.3, 109; 256/25; 5/99 A, 99 B, 99 C, 99 R, 98 R, 98 A, 98 B, 98 C, 93 R; 182/137, 138, 139; D6/331; D21/235

[56] References Cited

U.S. PATENT DOCUMENTS

| | | | |
|---|---|---|---|
| D. 187,138 | 2/1960 | Highberger | 272/65 X |
| D. 196,558 | 10/1963 | Choy et al. | D6/331 |
| 1,260,886 | 3/1918 | Eberle | 256/25 |
| 1,374,333 | 4/1921 | Stotler et al. | 5/99 R |
| 1,413,068 | 4/1922 | Stotler et al. | 5/98 B |
| 1,479,967 | 1/1924 | Johnson | 5/93 R |
| 2,563,915 | 8/1951 | Boisselier | 5/98 B |
| 2,588,722 | 3/1952 | Hendershott | 272/65 X |
| 2,837,752 | 6/1958 | Wilkerson | 5/99 R |
| 3,162,865 | 12/1954 | Tigrett | 5/99 A X |
| 3,430,271 | 3/1969 | Junod-Deile | D6/331 X |
| 3,886,607 | 6/1975 | Dunn | 5/99 A X |
| 3,983,585 | 10/1976 | Sidlingler | 272/65 X |
| 4,077,623 | 3/1978 | Clausell | 272/65 X |
| 4,415,151 | 11/1983 | Daniels | 272/65 |
| 4,516,767 | 5/1985 | Eskijian . | |
| 4,538,309 | 9/1985 | Gunter | 5/99 C X |
| 4,569,515 | 2/1986 | Gordon | 272/65 |

FOREIGN PATENT DOCUMENTS

| | | | |
|---|---|---|---|
| 1128085 | 7/1982 | Canada . | |
| 1129154 | 8/1982 | Canada | 5/99 R |
| 2026417 | 12/1971 | Fed. Rep. of Germany | 5/99 B |

OTHER PUBLICATIONS

Safe T Pen ® product information literature, Portable Technology, Inc., Homewood, Ala., pp. 1–4, 7–1985.

*Primary Examiner*—Richard J. Apley
*Assistant Examiner*—David J. Bender
*Attorney, Agent, or Firm*—Kenyon & Kenyon

[57] ABSTRACT

There is provided a new and useful playpen and exercise structure for an infant or small child comprising a lower frame section having a resilient surface supported therein, an upper frame section, a series of support members depending from the lower frame section for supporting the upper frame section, and a curtain secured continuously at the top to the upper frame section and at the bottom to the resilient surface.

19 Claims, 5 Drawing Sheets

EXERCISER AND PLAYPEN STRUCTURE HAVING A TRAMPOLINE LIKE BOTTOM

This application relates to a playpen and exercise structure for an infant or small child.

BACKGROUND OF THE INVENTION

Continuous development efforts have taken place over many years aimed at developing for infants and very small children playpens which offer a very high degree of safety. As well, various types of toys and amusement devices have been designed into playpens in an attempt to keep the occupant amused for more extended periods of time. To a lesser extent such structures have included more practical aids to the child such as grab rings and the like to enable the child to pull itself to an erect position.

While these structures have been successful in varying degrees, there has been an ongoing need in all of these cases to develop improved structures.

It is against this background that the present invention arises. The invention provides a playpen structure incorporating a trampoline-like bottom and numerous safety features. The structure takes advantage of the natural propensity of many infants and small children to enjoy a bouncing motion. This activity provides many of the well known benefits associated with large sized trampolines and, in addition, is of particular benefit in the development of balance and of the lower body muscles.

PRIOR ART

Applicant is not aware of any specific prior art that is of particular relevance to the claimed combination. There is prior art which relates to various configurations of trampolines which are in a general sense related to the bottom part of the present invention.

These include Canadian Pat. No. 1,128,085, issued July 20, 1982, to McNeil and directed to a round trampoline with U-shaped leg; U.S. Pat. No. 4,516,767, issued May 14, 1985, to Eskijian for an inflatable platform for repetitive bouncing; and U.S. Pat. No. 4,433,838, issued Feb. 28, 1984, to Gordon for an exercise structure and ball game. The first two of these illustrate variations in round trampolines, and the third adds a superstructure intended to prevent a user from falling off of the trampoline surface.

SUMMARY OF THE INVENTION

The invention provides a playpen having a trampoline-like bottom and a curtain or side wall which is spaced from all of the supporting framework with the exception of the top rail to which it is secured.

Accordingly, the invention provides a playpen structure comprising a lower frame section having a resilient surface supported therein, an upper frame section, a series of support members extending from said lower frame section for supporting said upper frame section, and a curtain secured continuously at the top to said upper frame section and at the bottom to said resilient surface.

In a preferred embodiment of the invention a part of the side wall or curtain is constructed of a resilient material.

BRIEF DESCRIPTION OF THE DRAWINGS

In drawings which illustrate embodiments of the invention.

Figure 2:
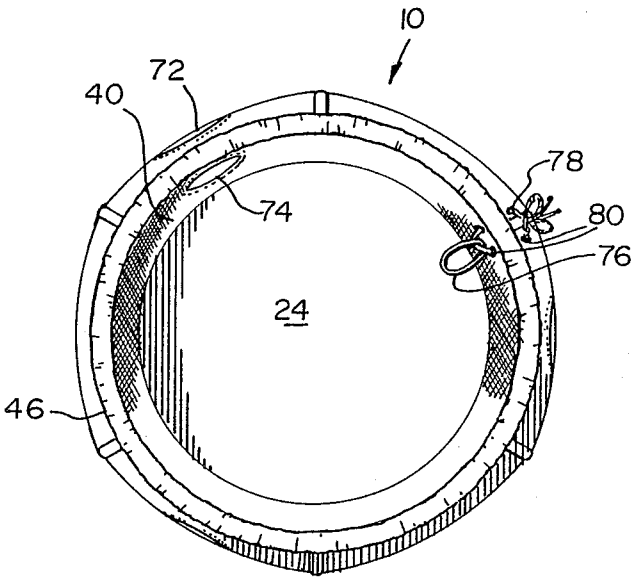
FIG. 2 is a top plan view the embodiment of FIG. 1.
Figure 1:
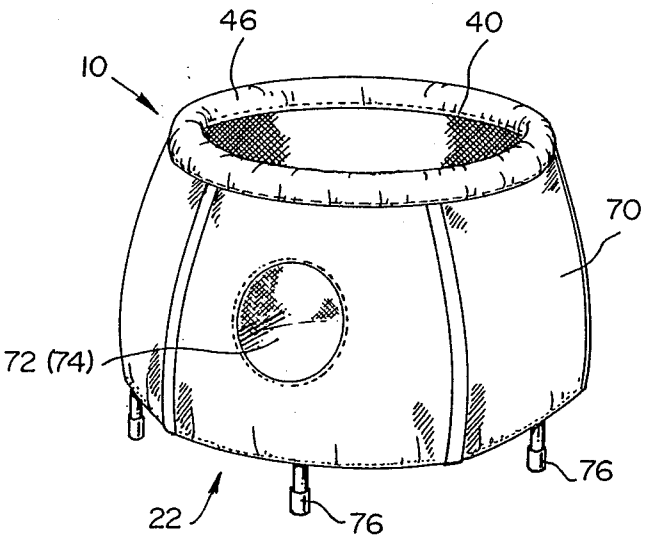
FIG. 1 is a perspective view of an embodiment according to the invention.
Figure 4:
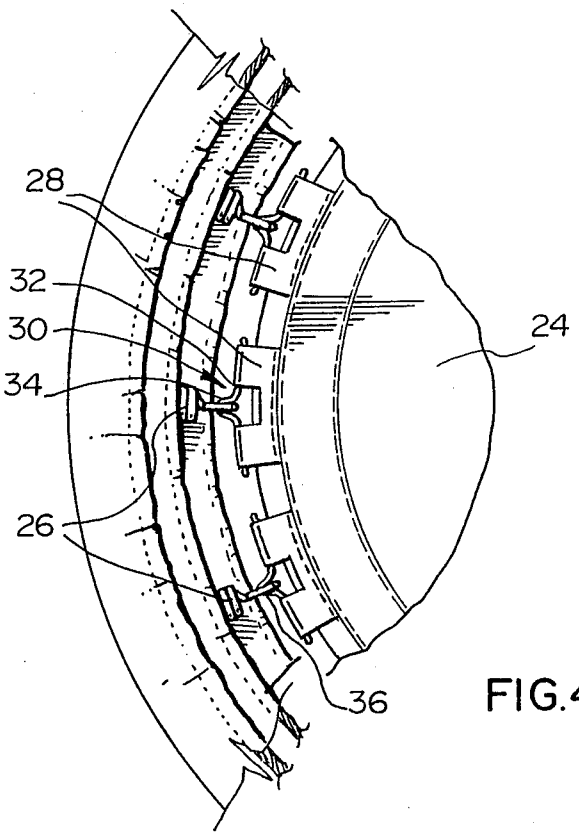
FIG. 4 is an enlarged view of a part of FIG. 3.
Figure 3:
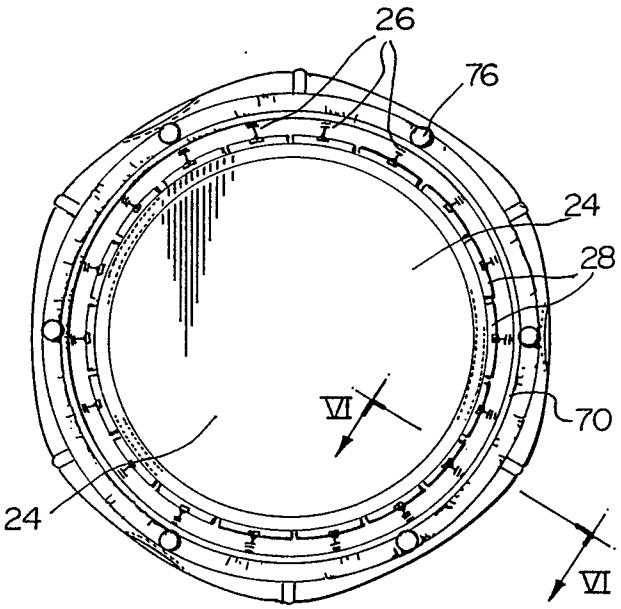
FIG. 3 is a bottom plan view of the embodiment of FIG. 1.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

With reference to FIGS. 1 to 5 of the drawings, the playpen structure 10 includes a lower peripheral frame section 12, an upper peripheral frame section 14 and a series of support members 16. The support members 16 are supported at one end 18 by the lower frame section 12 and in turn support at their top ends 20 the upper frame section 14.

As illustrated in FIGS. 1 to 5, the upper and lower frame sections are each of circular configuration, and the upper section is of smaller diameter than the lower section. As well, the support members 16 are illustrated in a preferred convexly bowed configuration.

The configuration of the upper and lower frame sections can differ from circular and, for example, in one preferred embodiment to be described below, is rectangular. It is preferred in all cases, however, that the perimeter of the upper frame section be within the perimeter of the lower section.

The base or floor section 22 includes in addition to the lower frame section 12, a resilient central part 24 secured within the frame section 12. While the central part 24 could be secured to section 12 in a variety of suitable ways, the preferred configuration is to utilize a series of springs 26 for this purpose. The central part 24 is provided with a series of loop pairs 28 with each pair receiving therein a retaining device 30. Each such device 30 preferably simply comprises a rod 32 bent or formed in a centre section thereof into a generally semicircular U-shaped projection 34. Each of said springs 26 is connected at one end 36 to the projection 34 and at the other end 38 to the lower frame section 12.

This manner of connection leaves the springs 26 free to rotate over a range of movement in a vertical direction relative to the central part 24 and the lower frame section 12 to thereby avoid binding and to allow for a smoother vertical movement of central part 24.

An alternative fastening technique for the springs is described later.

Figure 5:
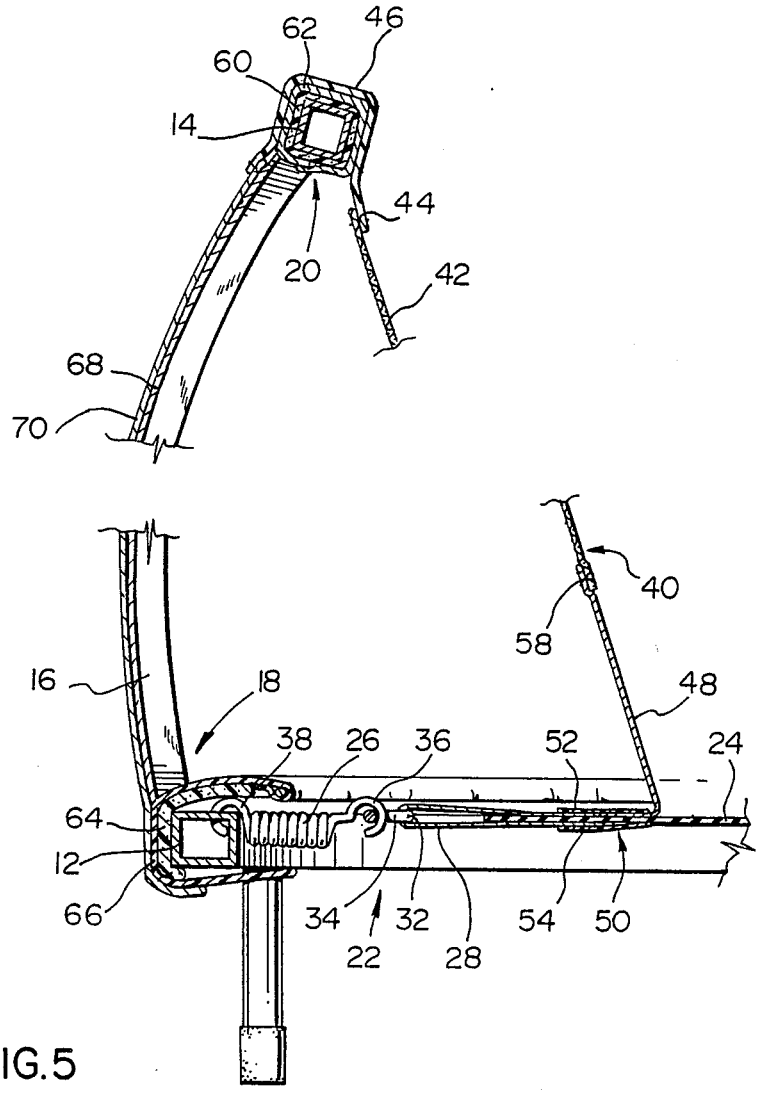
FIG. 5 is a cross-section through one side of the structure.

The curtain 40 is secured to the upper frame section 14 and to the resilient central part 24. As illustrated in FIG. 5, the top section 42 of curtain 40 is secured as by welding along the seam 44 to the cap 46 which is in turn secured around the upper frame section 14.

The lower section 48 of the curtain 40 is secured again, for example, by welding along a seam 50 to resilient part 24. The seam is strengthened by the application above and below of the preferably resilient members 52 and 54.

As illustrated, and as is preferred the lower portion or strip 48 of curtain 40 is comprised of an elastic material bonded as at 58 to the upper section 42 of curtain 40 to stretch in response to a downward movement of the central part 24 of the floor section 22 relative to the lower frame section 12.

The result of this construction is that an infant playing within the enclosure is isolated from all potentially dangerous parts of the structure with the exception of the upper frame section 14. Thus, the curtain 40 is spaced from the support members 16 to avoid any danger from the latter and is bonded to the central part 24 to positively prevent any part of the infant's body from egressing between the curtain 40 and section 24. To complete the safety considerations pertaining to the inside of the enclosure, the upper frame section 14 is preferably heavily padded by the padding layers 60 and 62.

As well, the lower frame section 12 is preferably isolated by the padding 64. A covering section 66 extends over padding 64 and around lower frame section 12, covering as well the outer and more easily reached part of the springs 26.

Further external protection is provided by the padding 68 on the support members 16. The whole of the exterior sides of the enclosure are then covered by a quilted covering 70.

An added safety feature is provided by the transparent windows 72 and 74 in the covering 70 and curtain 40 respectively. A series of these openings will preferably be provided to allow observation of an infant within the enclosure from various angles.

In the preferred case the enclosure is provided with suspended hand grips such as loop 76 which is suspended from a cord 78 running around a support member 16 via grommets 80. The hand grip enables an infant to pull itself to an erect position.

In use the enclosure takes advantage of the propensity of infants and small children to utilize an up and down bounce-like movement of their bodies. By gripping the upper frame section 14 with its hands while standing erect, and then adopting the up and down movement of the body, the infant takes advantage of the rebounding effect of the central part 24 and the elastic lower section 48 of the curtain 40. The infant is thereby encouraged to improve balance and to obtain the benefits of additional exercise. Of additional substantial benefit is the fact that the infant is kept amused for extended periods.

A highly preferred embodiment is illustrated in FIGS. 6 to 9. This embodiment represents a folding apparatus which permits much more convenient transport and storage.

In FIGS. 6 to 9 the playpen structure 90 includes a lower frame section 92, an upper frame section 94 and a series of support members 96. The support members 96 comprise upper sections 98 and lower sections 100. The sections 98 and 100 are connected by the brackets 102. Brackets 102 permit rotation between sections 98 and 100. The sections 98 are rotatably secured to the upper frame section 94 at points 104. Sections 100 are similarly rotatably secured to lower frame section 92 at points 106 in brackets 107.

A locking mechanism is provided for retaining the support members 96 in the extended position illustrated in the drawings. The locking mechanism 108 preferably consists of the bracket 110 and a spring biased locking button 112. The bracket 110 is provided with a slot 114. The slot 114 cooperates with the spring loaded locking button 112 which projects from the upper section 98 of support members 96. When the members 96 are in the extended position shown in the drawings, the button 112 projects through the slot 114 and prevents relative rotation of sections 98 and 100 about the pivot pin 116. When it is desired to collapse the structure, pressure is applied to the button 112 and the sections 98 and 100 rotated to move button 112 out of alignment with slot 114.

In the preferred case a safety ring 118 is provided on the frame section 98 and which is slidable over the end of lower section 100 to bring up against the bracket 110. The ring prevents collapsing of the frame by inadvertent pressure on the locking button 112.

The brackets 107 by which the sections 100 are connected to lower frame section 92 also preferably extend below lower frame section 92 to provide a connection for rotation for supporting legs 122. Legs 122 are preferably provided with a locking mechanism 124 which operates in the same way as mechanism 108. The locking button 126 and slot or opening 128 are preferably incorporated into bracket 107.

As described, release of the locking mechanism 108 and rotation of the sections 98 and 100 of support members 96 will enable the frame to collapse such that the upper frame section 92 and the lower frame section 94 are brought very close together. Collapsing of supporting legs 122 then provides a very compact assembly for storage or transport.

When the remainder of the structure is added to the frame, as will be described below, the various fabric parts may provide some interference in collapsing the structure, so that the upper frame section 94 and the lower frame section 92 may be separated by a short distance, but this does not affect the structure for practical purposes.

For purposes of safety, the preferred configuration for lower frame section 92 and upper frame section 94 is such that the perimeter of the upper frame section 94 is within the upward projection of the perimeter of lower frame section 92. The upper sections 98 of support members 96 are profiled as illustrated at 132 to allow for this aspect.

Figure 6:
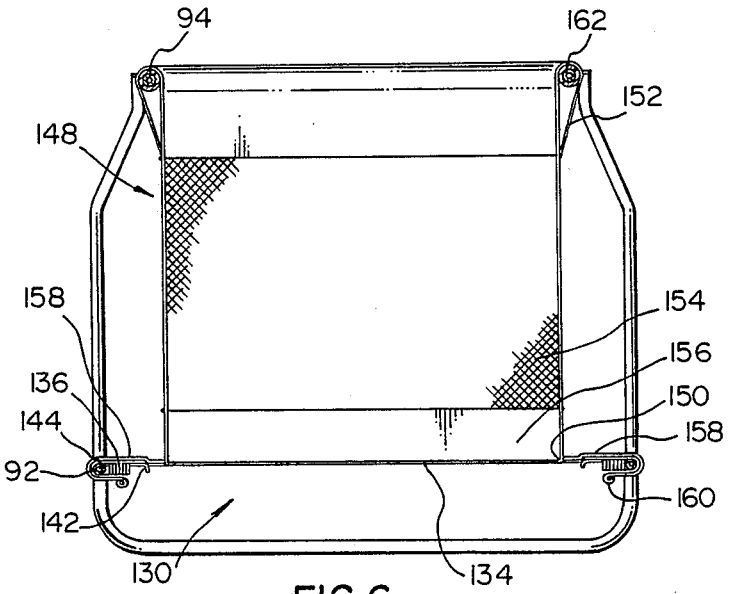
FIG. 6 is a cross section through a further embodiment of a structure according to the invention.
Figure 7:
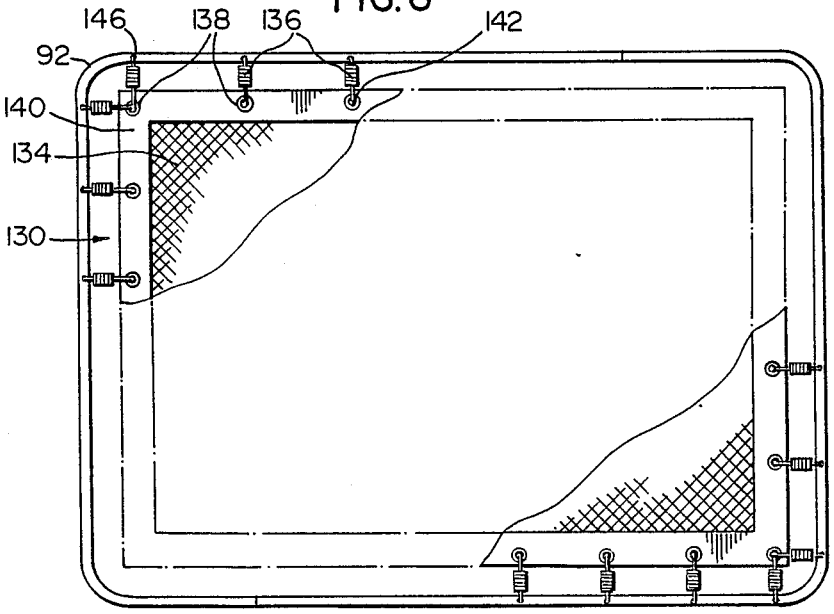
FIG. 7 is a top plan view of a part of the structure of FIG. 6.
Figure 8:
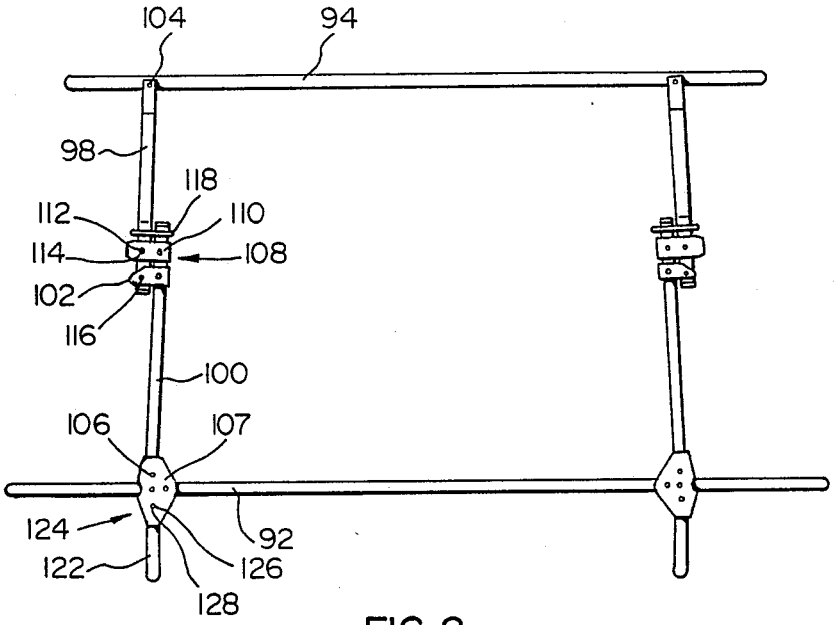
FIG. 8 is a side elevation of a frame structure for use in the invention.
Figure 9:
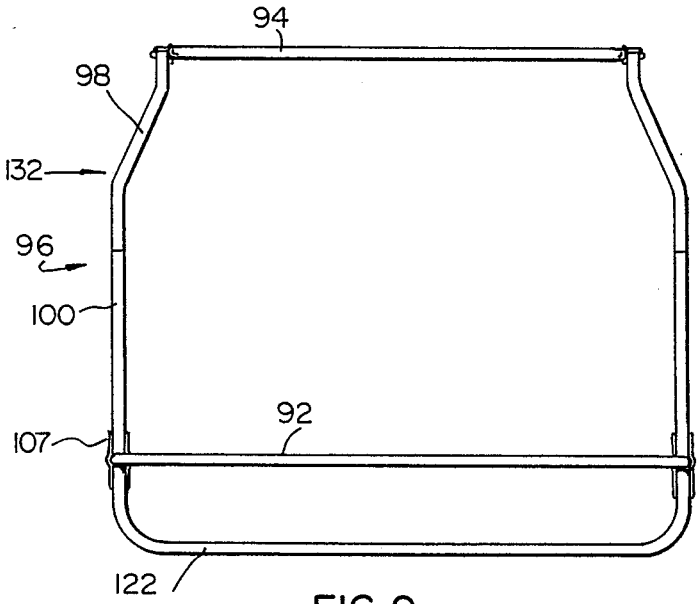
FIG. 9 is an end elevation of the frame structure of FIG. 8.

With reference to FIGS. 6 and 7, a floor section 130 includes a resilient central part 134 secured within the lower frame section 92. As with the embodiment of FIGS. 1 to 5, the central part 134 can be secured to the frame section 92 in a variety of ways. However, it is preferred that a series of springs 136 be utilized for this purpose. The manner of attaching the springs in the embodiment of FIGS. 6 to 9 has been simplified as follows. A series of eyelets 138 are provided in a reinforced area 140 about the periphery of the central part 134. One hooked end 142 of springs 136 is hooked into the eyelets 138. The other hooked end 144 is hooked into the openings 146 provided in the frame section 92. The curtain 148 is secured to the upper frame section 94 and to the resilient central part 134 along a seam 150. The seam 150 is preferably continuous so that there are no gaps of any kind between the curtain 148 and the resilient central part 134.

The curtain 148 is preferably secured to the upper frame section 94 by means of a continuous loop 152. The preferred construction of the curtain 148 as illustrated in FIGS. 6 to 9, comprises an upper part 154 constructed in an open weave to provide essentially a netting. The netting 154 provides an open field of vision relative to an infant in the structure.

The lower part 156 of the curtain 148 is preferably comprised of an elastic material similar to the central part 134 of floor 130.

As a further safety aspect, and similar to the embodiment of FIGS. 1 to 5, a covering section 158, extends from the seam 150 outwardly around the lower frame section 92 terminating in a loop 160. Various means can be inserted into loop 160 to maintain the covering section 158 in position.

In the preferred case covering section 158 is constructed of the same elastic material which forms the lower part 156 of curtain 148. This enables the covering section 158 to stretch and recover as required with movement of the central resilient part 134 and of the springs 136.

To complete the basic safety requirements the upper frame section 94 is provided with a substantial layer of padding 162. An infant within the structure is thus provided with complete protection. Additional protective material may be provided on the frame on the outside of the structure, but it will be appreciated that this is not necessary to protect an infant user.

Thus it is apparent that there has been provided in accordance with the invention a play and exercise structure for an infant or small child that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An exercise and play zstructure comprising
- a lower peripheral frame section having a resilient surface supported therein,
- an upper frame section,
- a series of rigid support members extending from said lower frame member for supporting said upper frame member, and
- a curtain extending around the interior of said upper frame section and secured continuously at the top thereof to said upper frame section and at the bottom thereof to said resilient surface, said curtain having a portion of an elastical material to stretch in response to a bounce-like movement of said resilient surface.

2. The structure of claim 1 comprising, in addition, means for supporting said lower frame section above a supporting surface.

3. The structure of claim 1 in which said series of support members are of convexly bowed configuration relative to the interior of said device.

4. The structure of claim 1 in which said resilient surface comprises a central section of flexible material secured by resilient members around its periphery to said lower frame section.

5. The structure of claim 4 in which said curtain is secured at the bottom thereof within the perimeter of said flexible material.

6. The structure of claim 4 in which said resilient members are springs.

7. The structure of claim 1 in which said upper and lower peripheral frame sections are circular.

8. An exercise and play structure comprising
- a lower peripheral frame section having a resilient surface supported therein;
- an upper peripheral frame section;
- a series of support sections extending from said lower frame section for supporting said upper frame section, said support sections each comprising upper and lower vertical support members pivotally connected to each other and pivotally connected to respective ones of said upper and lower frame sections, said support sections movable between a collapsed position and an extended position; and
- a curtain extending around the interior of said upper frame section and secured continuously at the top thereof to said upper frame section and at the bottom thereof to said resilient surface, said curtain having a portion of an elastic material to stretch and recover in response to a bounce-like movement of said resilient surface.

9. The structure of claim 8 including means for locking said support sections in the extended position.

10. The structure of claim 8 including means for supporting said lower frame section above a supporting surface.

11. The structure of claim 8 in which said upper and lower frame sections are substantially horizontal.

12. The structure of claim 8 in which said upper and lower frame sections are rectangular in configuration.

13. The structure of claim 8 in which said resilient surface comprises a central section of flexible material secured by resilient members around its periphery to said lower frame section.

14. The structure of claim 13 including a protective apron of resilient material extending around said structure between the line of joining of said curtain to said resilient surface and said lower frame member and above said resilient members.

15. The structure of claim 13 in which said resilient members are springs.

16. The structure of claim 13 in which said curtain is secured within the perimeter of said central section.

17. An exercise and playpen structure comprising
- a lower peripheral frame section;
- an upper peripheral frame section;
- a plurality of vertically disposed support members rigidly connected between and to said frame sections;
- a floor section disposed within said lower frame section;
- a series of springs connecting said floor section to said lower frame section to permit said floor section to move vertically relative to said frame sections; and
- a curtain secured to and between said upper frame section and said floor section in horizontally spaced relation from said springs and said lower frame section to isolate an infant therefrom, said curtain having a section of elastic material to stretch and recover in response to a bounce-like movement of said floor section.

18. A structure as set forth in claim 17 wherein said frame sections are of rectangular shape.

19. A structure as set forth in claim 17 wherein said section of said curtain is a lower section secured to said floor.

* * * * *

UNITED STATES PATENT AND TRADEMARK OFFICE

CERTIFICATE OF CORRECTION

PATENT NO. : 4,900,011

DATED : Feb. 13, 1990

INVENTOR(S) : LEOPOLD NOLET

It is certified that error appears in the above-identified patent and that said Letters Patent is hereby corrected as shown below:

Column 2, line 7 "view the" should be -view of the-
Column 3, line 11 "preferred the" should be -preferred, the-
Column 5, line 45 "zstructure" should be -structure-

Signed and Sealed this

Ninth Day of July, 1991

*Attest:*

HARRY F. MANBECK, JR.

*Attesting Officer*

*Commissioner of Patents and Trademarks*